US011047081B2

(12) United States Patent
Sawada et al.

(10) Patent No.: US 11,047,081 B2
(45) Date of Patent: Jun. 29, 2021

(54) OVERLOCK SEWING MACHINE

(71) Applicant: JANOME SEWING MACHINE CO., LTD., Tokyo (JP)

(72) Inventors: Takuya Sawada, Tokyo (JP); Ushio Yokoyama, Tokyo (JP); Eiichi Shomura, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 16/901,272

(22) Filed: Jun. 15, 2020

(65) Prior Publication Data

US 2020/0308747 A1 Oct. 1, 2020

Related U.S. Application Data

(63) Continuation of application No. PCT/JP2019/001298, filed on Jan. 17, 2019.

(30) Foreign Application Priority Data

Jan. 30, 2018 (JP) ..... JP2018-013311

(51) Int. Cl.
*D05B 57/06* (2006.01)
*D05B 63/02* (2006.01)
*D05B 73/04* (2006.01)

(52) U.S. Cl.
CPC ..... *D05B 57/06* (2013.01); *D05B 63/02* (2013.01); *D05B 73/04* (2013.01)

(58) Field of Classification Search
CPC ..... D04B 57/06; D04B 57/04; D04B 57/02; D04B 63/02; D04B 69/24; D04B 73/04
See application file for complete search history.

(56) References Cited

U.S. PATENT DOCUMENTS 4,498,405 A * 2/1985 Hanyu ..... D05B 1/12 112/163
5,233,935 A * 8/1993 Winter ..... D05B 83/00 112/199

(Continued)

FOREIGN PATENT DOCUMENTS

JP H5-070483 U 9/1993
JP H9-038369 A 2/1997

(Continued)

OTHER PUBLICATIONS

International Search Report issued in PCT/JP2019/001298 dated Apr. 23, 2019 with English Translation (4 pages).

(Continued)

*Primary Examiner* — Danny Worrell
(74) *Attorney, Agent, or Firm* — Nakanishi IP Associates, LLC

(57) ABSTRACT

An overlock sewing machine includes: a looper cover detection member movable from non-switching to switching positions with looper cover open to closed state transition, with switching member operation switching the threading mechanism state to sewing-enabled after looper cover detection member movement to switching position; a side cover detection member movable from non-detection to detection positions with side cover open to closed state transition; and a lever coupled to the looper cover detection member and side cover detection member, switchable between states of pressing and not pressing the operating protrusion, following looper cover detection member and side cover detection member operating states. The lever is set to the pressing state upon movement of the looper cover detection member to switching position and of the side cover detection member to detection position.

6 Claims, 8 Drawing Sheets

(56) References Cited

U.S. PATENT DOCUMENTS

| | | | | |
|---|---|---|---|---|
| 5,388,540 | A * | 2/1995 | Satoma | D05B 77/00 112/261 |
| 5,544,601 | A * | 8/1996 | Baba | D05B 83/00 112/162 |
| 9,290,872 | B2 | 3/2016 | Ishikawa | |
| 9,347,163 | B2 | 5/2016 | Sakuma et al. | |
| 9,695,536 | B2 | 7/2017 | Shomura | |
| 2014/0190383 | A1 | 7/2014 | Ishikawa | |
| 2015/0167218 | A1 | 6/2015 | Sakuma et al. | |
| 2016/0215425 | A1 | 7/2016 | Shomura | |
| 2019/0169774 | A1 | 6/2019 | Shomura | |

FOREIGN PATENT DOCUMENTS

| | | | |
|---|---|---|---|
| JP | 2588420 | Y2 | 1/1999 |
| JP | 2013-063221 | A | 4/2013 |
| JP | 2014-018292 | A | 2/2014 |
| JP | 2016-137028 | A | 8/2016 |
| JP | 2018-23666 | A | 2/2018 |

OTHER PUBLICATIONS

Office Action issued in German Patent Application No. 112019000583.9 dated Mar. 3, 2021, with English Translation of Main Body (13 pages).

* cited by examiner

OVERLOCK SEWING MACHINE

CROSS-REFERENCE TO RELATED APPLICATIONS

This application is a continuation application of International Patent Application No. PCT/JP2019/001298 filed on Jan. 17, 2019, which claims priority to Japanese Patent Application No. 2018-013311 filed on Jan. 30, 2018, the entire contents of which are incorporated by reference.

BACKGROUND OF THE INVENTION

1. Field of the Invention

The present invention relates to an overlock sewing machine.

2. Description of the Related Art

A technique has been disclosed in Patent documents 1 and 2 listed below for an overlock sewing machine in which looper threading is supported by a pump driving operation, and a main shaft for sewing is driven by a single motor using clutch switching. This technique prevents abnormal switching in such an overlock sewing machine between a threading state and a sewing state. The technique is supported by providing separate respective switches, i.e., a switch used to detect an open/closed state of a looper cover or the like and a switch used to detect the switching between the looper threading state and the sewing-enabled state.

RELATED ART DOCUMENTS

Patent Documents

[Patent document 1]

Japanese Patent Application Laid Open No. 2013-063221

[Patent document 2]

Japanese Patent Application Laid Open No. 2014-018292

However, such an overlock sewing machine described in Patent documents 1 and 2 employs multiple switches. This involves complicated wiring, and leads to an increased cost. Furthermore, such an overlock sewing machine includes a side cover in addition to the looper cover. With such an arrangement, in a case of further providing an additional switch for detecting the open/closed state of the side cover, i.e., in a case in which the number of switches is further increased, this leads to further complicated wiring or the like. Accordingly, the overlock sewing machine is preferably configured to require only a single switch to detect the open/closed state of the looper cover and the side cover and to detect the threading switching state.

In view of the aforementioned fact, it is a purpose of the present invention to provide an overlock sewing machine configured to require only a single switch to detect the open/closed state of the looper cover and the side cover and to detect the threading switching state.

SUMMARY OF THE INVENTION

A first embodiment for solving the above-described issues relates to an overlock sewing machine. The overlock sewing machine comprises: a switching member configured to switch, between a threading state and a sewing-enabled state, a threading mechanism provided to a sewing machine main body so as to support threading for a looper; a looper cover coupled to a hinge shaft arranged on a front side of the threading mechanism with the left-right direction as an axial direction thereof, such that it can be operated to switch between an open state and a closed state; a side cover coupled to the sewing machine main body such that it is positioned on one side with respect to the threading mechanism defined in the left-right direction and such that it can be operated to switch between an open state and a closed state; a switch comprising an operating protrusion, and configured such that, when the operating protrusion is pressed, the switch detects the closed state of the looper cover, the closed state of the side cover, and the sewing-enabled state of the threading mechanism; a looper cover detection member configured to operate such that it is moved from a non-switching position to a switching position according to a transition of the looper cover from the open state to the closed state, and such that, after the looper cover detection member reaches the switching position, the looper cover detection member operates the switching member so as to switch the threading mechanism to the sewing-enabled state; a side cover detection member configured to operate such that it is moved from a non-detection position to a detection position according to a transition of the side cover from the open state to the closed state; and a lever coupled to the looper cover detection member and the side cover detection member, and configured to switch between a pressing state in which it presses the operating protrusion and a non-pressing state in which it does not press the operating protrusion, according to an operating state of the looper cover detection member and an operating state of the side cover detection member. When the looper cover detection member is moved to a switching position and the side cover detection member is moved to a detection position, the lever is set to the pressing state.

A second embodiment for solving the above-described issues also relates to the overlock sewing machine. The looper cover detection member is configured such that, when it is moved from the non-switching position toward one side in the left-right direction, it is set to the switching position. The side cover detection member is configured such that, when it is moved from the non-detection position toward the other side in the left-right direction, it is set to the detection position. The lever is rotatably coupled to the side cover detection member by a first pin. A cam groove is formed in the lever such that a second pin provided to the looper cover detection member is inserted into the cam groove so as to allow the second pin to be moved.

A third embodiment for solving the above-described issues also relates to the overlock sewing machine. The side cover detection member is supported by the sewing machine main body such that it can be relatively moved, and is forced toward the non-detection position side by a force-applying member. When the side cover is switched from the open state to the closed state, the side cover detection member is pressed by the side cover so as to move the side cover detection member from the non-detection position to the detection position.

A fourth embodiment for solving the above-described issues also relates to the overlock sewing machine. The switch is fixed by a switch fixing member. The first pin and the second pin are slidably coupled to the switch fixing member.

A fifth embodiment for solving the above-described issues also relates to the overlock sewing machine. The looper cover and the hinge shaft are configured such that they can be moved as a single unit in an axial direction of the hinge shaft. When the looper cover is moved to a completely closed position toward one side in the axial direction of the hinge shaft from an interim closed state after it is turned from the open state to the closed state so as to be set to the interim closed state, the looper cover is switched to the closed state. An engagement portion is formed in the looper cover detection member so as to allow the hinge shaft to be engaged with the engagement portion such that they can be moved as a single unit in the axial direction of the hinge shaft.

A sixth embodiment for solving the above-described issues also relates to the overlock sewing machine. The hinge shaft is rotatably supported by a support member, and is forced by a shaft force-applying member toward one side in the axial direction. A cam portion is formed in the support member such that, when the looper cover is set to the open state, it is engaged with the looper cover so as to restrict the movement of the looper cover toward one side in the axial direction of the hinge shaft. Upon turning the looper cover from the open position to the interim closed position, the engagement state between the cam portion and the looper cover is released so as to enable the movement of the looper cover toward the one side in the axial direction of the hinge shaft.

Advantage of the Present Invention

With the overlock sewing machine having the above-described configuration, this arrangement requires only a single switch to detect the open/closed state of the looper cover, the open/closed state of the side cover, and the threading switching state.

DESCRIPTION OF THE PREFERRED EMBODIMENTS

Figure 1:
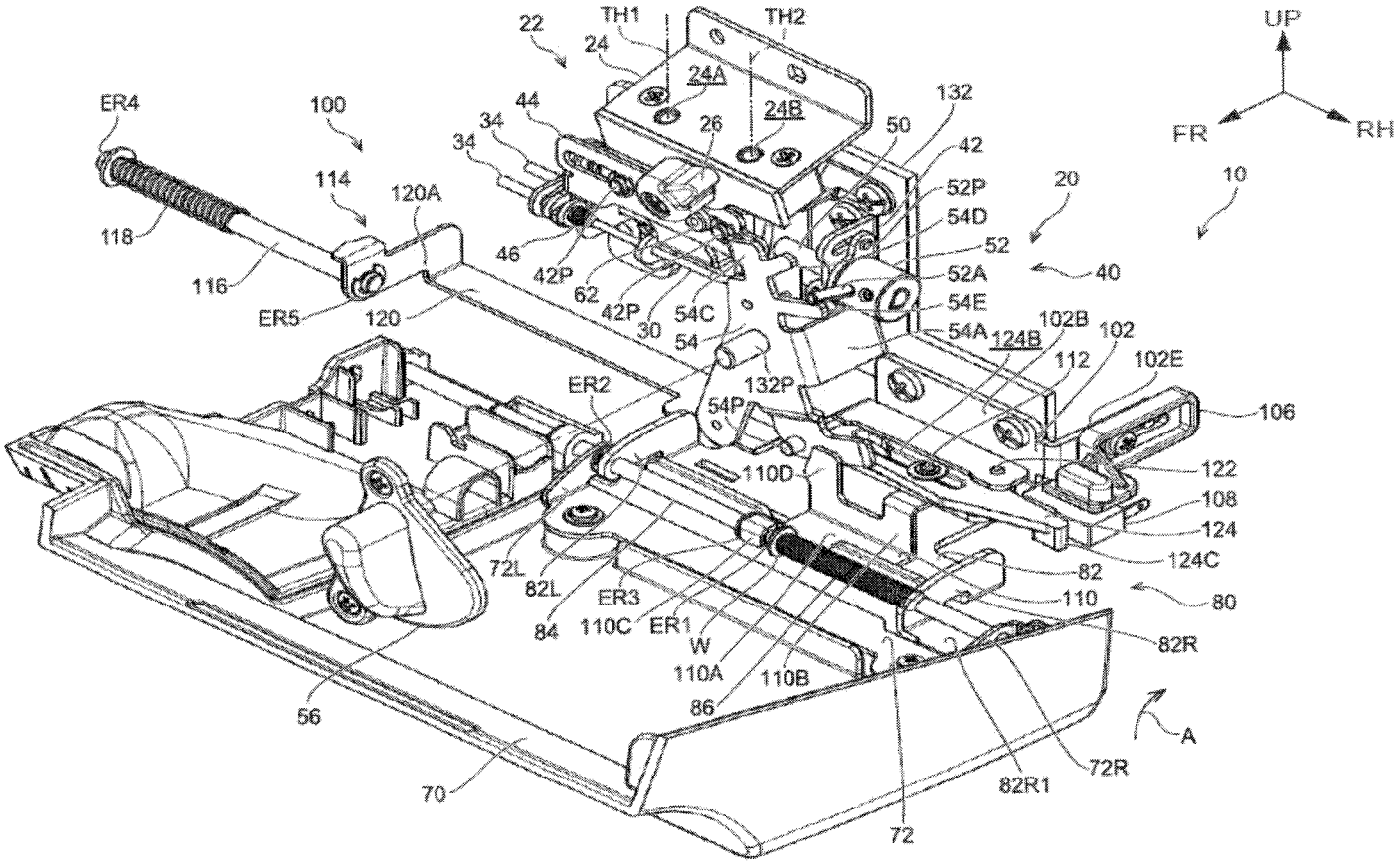
FIG. 1 is a perspective view showing main components of the overlock sewing machine according to the present embodiment in a state in which a looper cover is opened and a front cover is detached.

Description will be made below regarding an overclock sewing machine 10 according to the present invention. It should be noted that, in the drawings shown as appropriate, the arrow UP indicates the upper side of the overlock sewing machine 10, the arrow FR indicates the front side thereof, and the arrow RH indicates the right side thereof. The directions used in the following description, i.e., the upper-lower direction, the front-rear direction, and the left-right direction, represent the upper and lower, front and rear, and left and right directions of the overlock sewing machine 10, unless otherwise noted.

Figure 2:
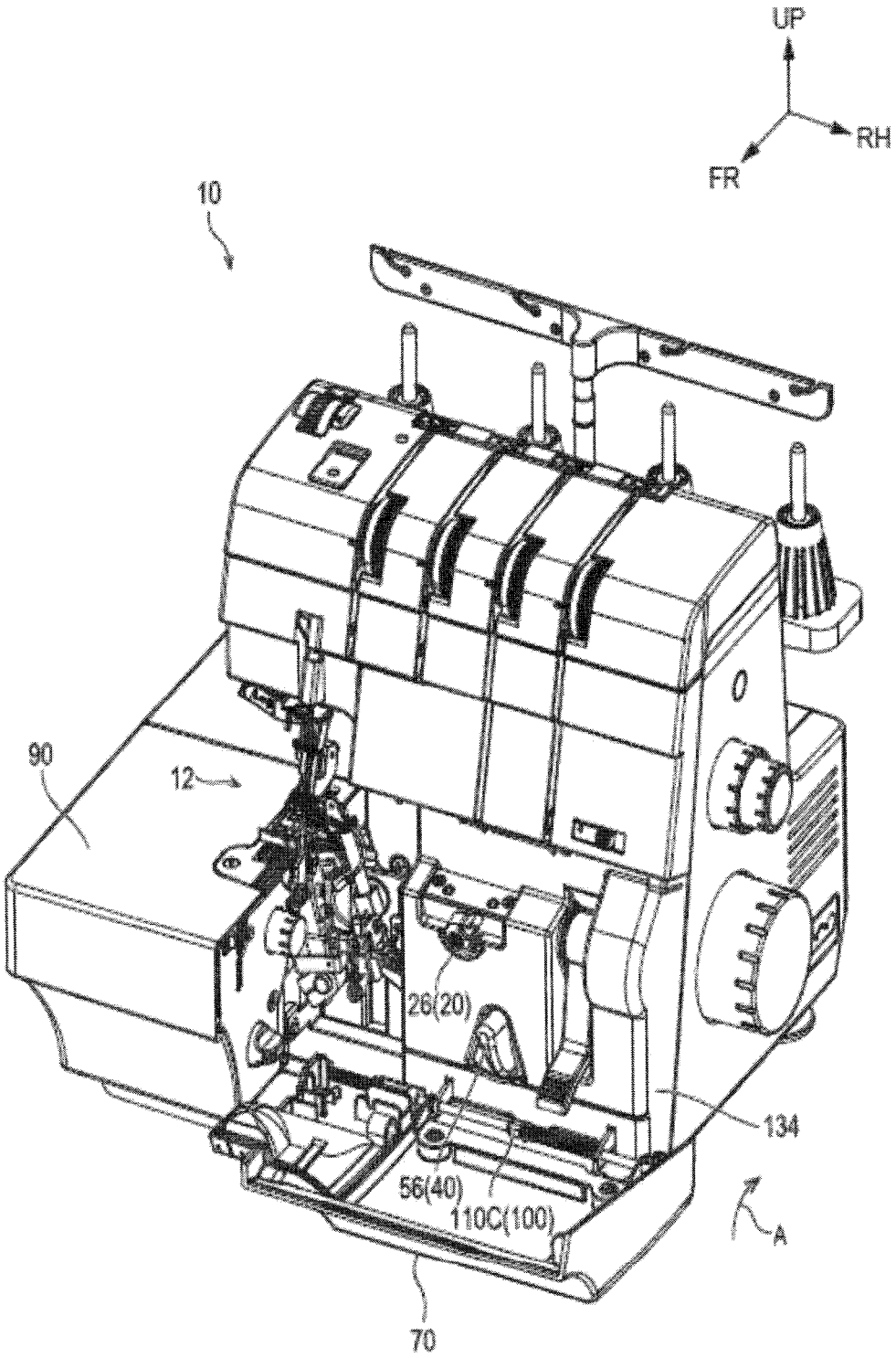
FIG. 2 is a perspective view showing the overall configuration of the overlock sewing machine in a state in which the looper cover is opened.

As shown in FIGS. 1 and 2, the overlock sewing machine 10 is configured including a looper unit 12, a threading mechanism 20, and a safety mechanism 100. With such an arrangement, as shown in FIG. 2, most of the threading mechanism 20 and the safety mechanism 100 is covered by a front cover 134 of the overclock sewing machine 10 such that it cannot be visually confirmed from the front side. Furthermore, the overlock sewing machine 10 includes a looper cover 70 that forms a lower-right front portion of the overlock sewing machine 10 and that covers the front cover 134 from the front side, and a side cover 90 that forms a housing of the left-side portion of the overlock sewing machine 10. Description will be made below regarding each component of the overlock sewing machine 10.

[Regarding the Looper Unit 12]

Figure 3:
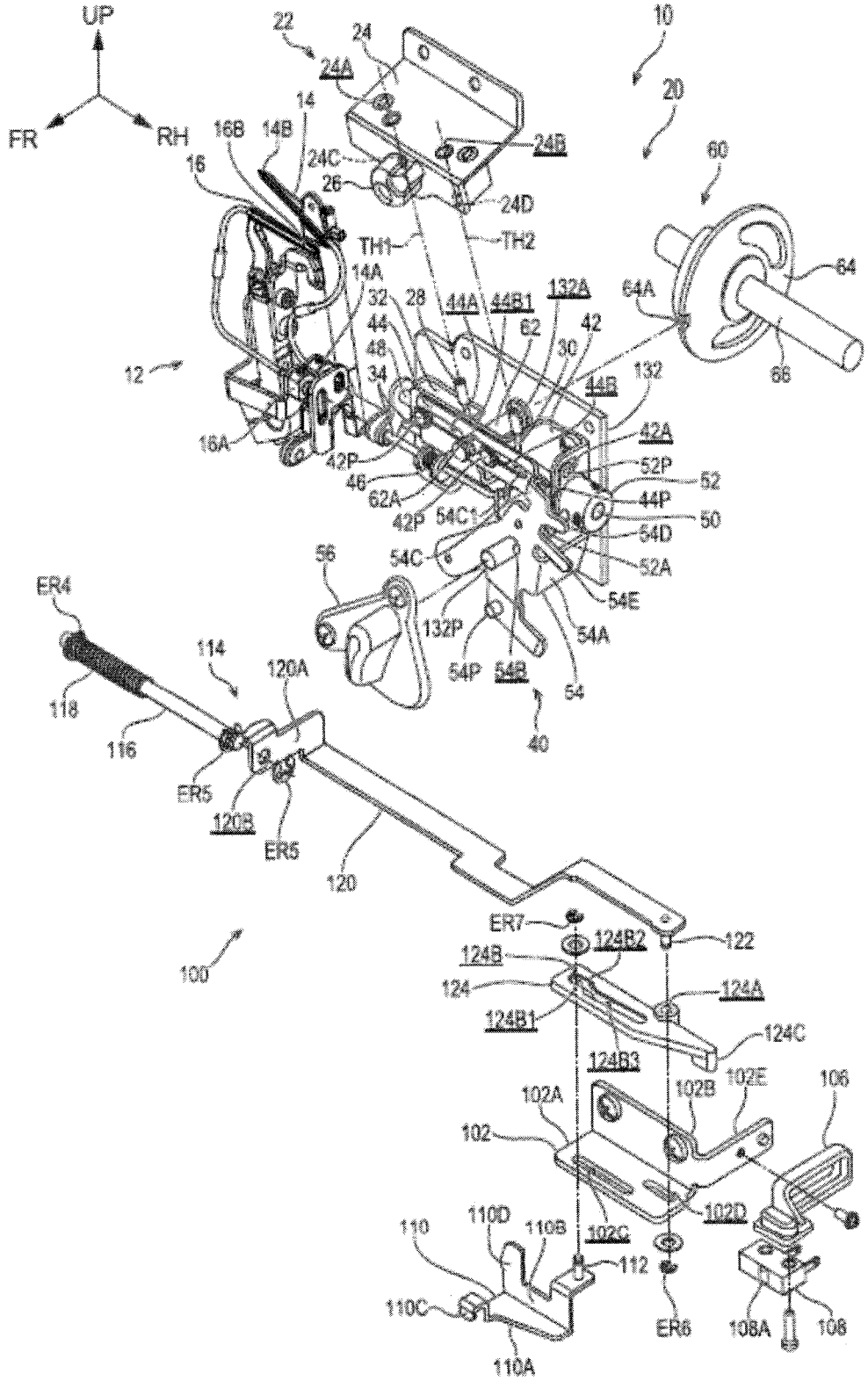
FIG. 3 is an exploded perspective view showing the main components of the overlock sewing machine shown in FIG. 1.
Figure 6:
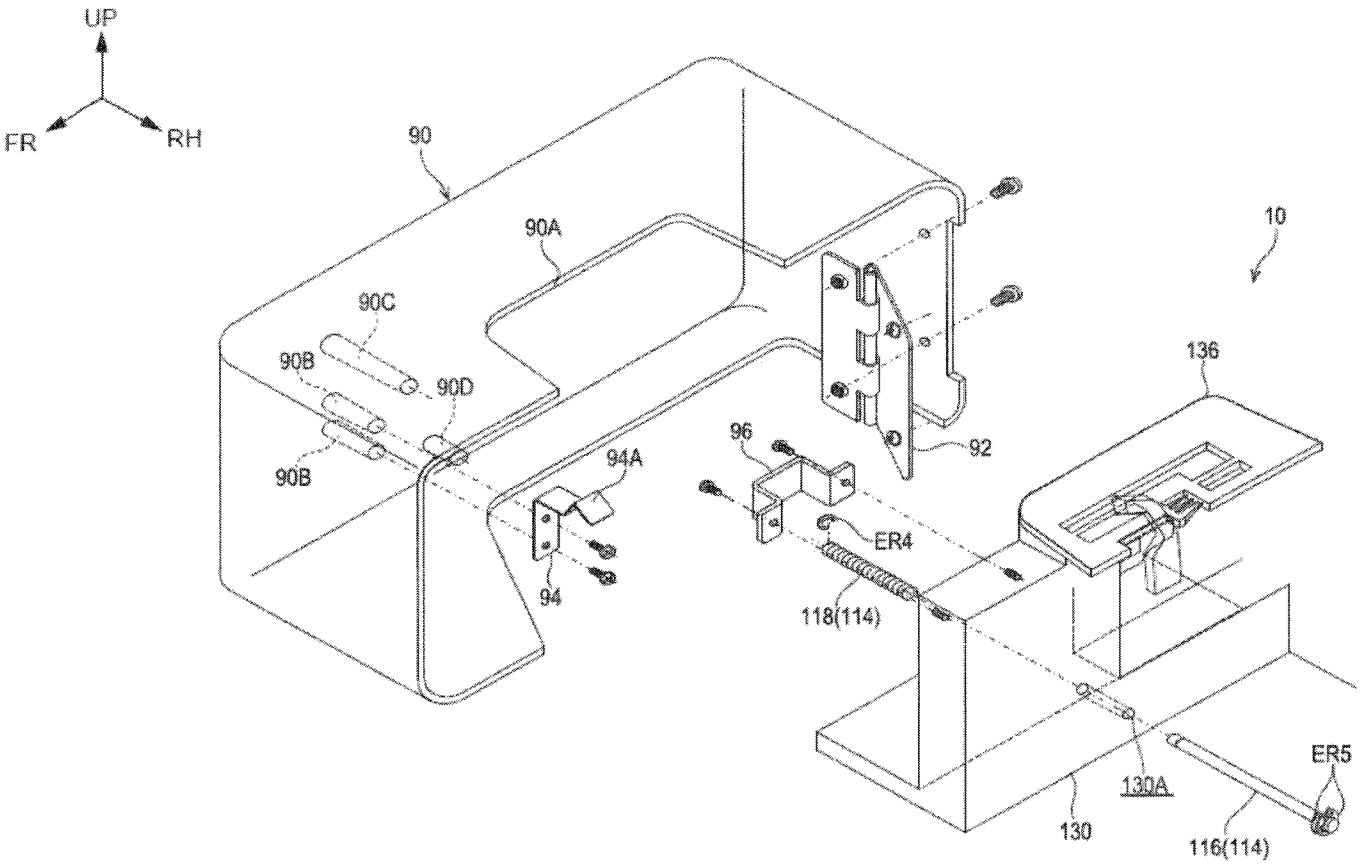
FIG. 6 is an exploded perspective view showing the side cover shown in FIG. 5.

As shown in FIG. 3, the looper unit 12 is arranged on the left side of a unit base 132 that forms a part of a sewing machine main body 130 (see FIG. 6). The looper unit includes an upper looper 14 and a lower looper 16 each configured as a "looper" having an approximately longitudinal, hollow structure. The upper looper 14 and the lower looper 16 have their base-end portions respectively configured as an upper looper inlet 14A and a lower looper inlet 16A, and have their tip-end portions respectively configured as an upper looper blade tip 14B and a lower looper blade tip 16B. The looper unit 12 is configured to allow the upper looper inlet 14A and the lower looper inlet 16A to receive an upper looper thread TH1 and a lower looper thread TH2 transferred via the threading mechanism 20 described later. With such an arrangement, the upper looper 14 and the lower looper 16 are configured such that they are reciprocally driven such that they intersect at an appropriate timing with a needle (not shown) driven in the upper-lower direction by the rotation of a main shaft 66 described later.

[Regarding the Threading Mechanism 20]

As shown in FIGS. 1 and 3, the threading mechanism 20 is configured including an air flow path switching mechanism 22, a threading switching mechanism 40, and a main shaft fixing mechanism 60. Furthermore, the threading mechanism 20 includes an upper looper conducting tube 28 and a lower looper conducting tube 30 configured to couple the air flow path switching mechanism 22 and the looper unit 12, and a pair of slide tubes 34.

[Regarding the Air Flow Path Switching Mechanism 22]

The air flow path switching mechanism 22 includes an approximately block-shaped main body portion 24. The main body portion 24 is fixed to the front face of the unit base 132. An upper looper thread insertion opening 24A and a lower looper thread insertion opening 24B are formed in the upper face of the main body portion 24. The upper looper thread insertion opening 24A and the lower looper thread insertion opening 24B are configured such that they communicate with an upper looper thread discharging tube 24C and a lower looper thread discharging tube 24D, respectively, provided to the lower face of the main body portion 24.

A selection knob 26 is provided on the front face of the main body portion 24. The air flow path switching mechanism 22 is configured to allow the user to operate the selection knob 26 to select the thread to be threaded from among an upper looper thread TH1 and a lower looper thread TH2. An unshown tube is arranged on the rear face of the main body portion 24. With this arrangement, the compressed air generated by a compressed air supply apparatus (not shown) is supplied to the air flow path switching mechanism 22 via the tube. Furthermore, the air flow path switching mechanism 22 is covered by the front cover 134 from the front side such that the selection knob 26 is exposed from the front cover 134 so as to allow the user to operate the selection knob 26 (see FIG. 2).

[Regarding the Upper Looper Conducting Tube 28 and the Lower Looper Conducting Tube 30]

The upper looper conducting tube 28 and the lower looper conducting tube 30 are each configured in an approximately inverted L-shaped structure as viewed from the front and are each arranged below the air flow path switching mechanism 22. Furthermore, the upper looper conducting tube 28 and the lower looper conducting tube 30 are arranged such that their upper-end portions are coupled to the upper looper thread discharging tube 24C and the lower looper thread discharging tube 24D, respectively. Moreover, the upper looper conducting tube 28 and the lower looper conducting tube 30 are arranged such that their left-side-end portions are supported by a tube support member 32 fixed to the unit base 132. It should be noted that the tube support member 32 is configured to have an approximately U-shaped plate structure having an opening that faces the front side as viewed in a plane view.

[Regarding the Slide Tubes 34]

A pair of slide tubes 34 are arranged on the left side of the upper looper conducting tube 28 and the lower looper conducting tube 30 with the left-side direction as their axial direction. The slide tubes 34 are arranged side by side in the front-rear direction. Furthermore, the left-end portions of the slide tubes 34 are supported by the left-side wall of the tube support member 32 such that they can be relatively moved in the left-right direction. Moreover, the right-end portions of the slide tubes 34 are inserted into the upper looper conducting tube 28 and the lower looper conducting tube 30, respectively, such that they can be relatively moved. This allows each slide tube 34 to be moved in the left-right direction between the threading position (position shown in FIG. 1) and the sewing-enabled position (position shown in FIG. 3). Specifically, when the slide tubes 34 are set to the threading position, the left ends of the slide tubes 34 are coupled to the upper looper inlet 14A and the lower looper inlet 16A, respectively. When the slide tubes 34 are set to the sewing-enabled position, the left ends of the slide tubes 34 are moved rightward away from the upper looper inlet 14A and the lower looper inlet 16A.

[Regarding the Threading Switching Mechanism 40]

The threading switching mechanism 40 is configured as a mechanism that switches the slide tubes 34 between the threading position and the sewing-enabled position. The threading switching mechanism 40 is configured including a support base 42, a slide plate 44, an operating shaft 50, and a switching member 54.

[Regarding the Support Base 42]

The support base 42 is configured to have an approximately longitudinal plate structure with the front-rear direction as the thickness direction and such that it extends in the left-right direction. The support base 42 is configured such that its right-side portion is bent so as to have an approximately U-shaped structure having an opening that faces the front side as viewed in a plan view. With such an arrangement, the right-side portion of the support base 42 is fixed to the unit base 132 by screwing on the right side of the tube support member 32. The left-side portion of the support base 42 is arranged on the front side of the tube support member 32. A pair of left and right pins 42P are provided to the left-side portion such that they protrude frontward.

[Slide Plate 44]

The slide plate 44 is arranged on the front side of the support base 42. The slide plate 44 is configured to have an approximately longitudinal plate structure with the front-rear direction as the thickness direction such that it extends in the left-right direction. A pair of left and right slide openings 44A and 44B are configured such that they pass through the slide plate 44 and such that they extend in the left-right direction. The pins 42P of the support base 42 are respectively inserted into the slide opening 44A and 44B such that they can be relatively moved. With this arrangement, the slide plate 44 is supported by the support base 42 such that it can be relatively moved in the left-right direction. Furthermore, a large-diameter portion 44B1 is formed as a left-end portion of the right-side slide opening 44B such that it has an approximately circular opening having a diameter that is larger than the width of the slide opening 44B.

Furthermore, the slide plate 44 is arranged such that its left-end portion is positioned on the inner side of the tube support member 32 described above. Furthermore, the left-end portion of the slide plate 44 is coupled to the slide tubes 34 by a slide tube spring 46 mounted on the slide tube 34 such that they can be monolithically moved as a single unit. With this arrangement, upon sliding the slide plate 44 leftward or rightward, the slide tubes 34 are moved toward the threading position or the sewing-enabled position.

Furthermore, the slide plate 44 is forced leftward by a compression spring (not shown) mounted on the support shaft of the support base 42. Moreover, a pin 44P is monolithically provided to the right-end portion of the slide plate 44 such that it protrudes frontward.

[Regarding the Operating Shaft 50]

The operating shaft 50 is arranged with the left-right direction as its axial direction, and is borne by the right-side portion (U-shaped bent portion) of the support base 42. In this state, the operating shaft 50 is rotatably supported by the support base 42. The operating shaft 50 is arranged such that its right-end portion protrudes rightward from the right wall of the support base 42. A switching transmission member 52 is provided to the right-end portion of the operating shaft 50. The switching transmission member 52 is configured to have an approximately cylindrical structure with the left-right direction as its axial direction. The right-end portion of the operating shaft 50 is inserted into the switching transmission member 52 such that the switching transmission member 52 can be rotated together with the operating shaft 50 as a single unit. Furthermore, an arm portion is provided to the left-side-end portion of the switching transmission mechanism 52 such that it extends upward. Moreover, a pin 52P is provided to the tip-end portion of the arm portion such that it protrudes leftward. The pin 52P is slidably inserted into a long opening 42A formed in the right wall of the support base 42 so as to have a curved arc structure. Furthermore, an engagement pin 52A is provided to the outer circumferential portion of the switching transmission member 52 such that it protrudes outward in a radial direction of the switching transmission member 52 (specifically, frontward).

[Regarding the Switching Member 54]

The switching member 54 is arranged on the front side of the right-end portion of the slide plate 44. The switching member 54 is configured to have a plate structure with the front-rear direction as the thickness direction. The switching mechanism 54 is configured to have an approximately V-shaped structure having an opening that faces diagonally downward and leftward as viewed from the front side. A support arm 54A is formed in the right-end portion of the switching member 54 such that it is positioned at an intermediate position in the upper-lower direction and such that it is bent rearward. Furthermore, the support arm 54A is configured such that its end portion (rear-end portion) is bent leftward. Furthermore, circular opening portions 54B are formed as through holes in an approximately central portion of the switching member 54 and the end portion of the support arm 54A. The opening portions 54B are arranged coaxially (FIG. 3 shows only one opening portion 54B formed in an approximately central portion of the switching member 54). With such an arrangement, a support shaft 132P fixed to the unit base 132 with the front-rear direction as its axial direction is inserted into the opening portions 54B. In this state, the switching member 54 is rotatably supported by the support shaft 132P.

A switching arm 54C is formed in the upper-end portion of the switching member 54. A contact tab 54C1 is formed as a left-side portion of the switching arm 54C such that it is bent rearward. With such an arrangement, the contact tab 54C1 is arranged adjacent to the left side of the pin 44P of the slide plate 44 described above.

Furthermore, a pair of an upper engagement arm 54D and a lower engagement arm 54E are formed in the upper portion of the switching member 54. The engagement arm 54D is configured such that it extends diagonally upward and rightward from the upper portion of the switching member 54. On the other hand, the engagement arm 54E is configured such that it is positioned below the engagement arm 54D and such that it extends rightward from the upper portion of the switching member 54. The engagement pin 52A of the switching transmission member 52 described above is arranged between the pair of engagement arms 54D and 54E.

Furthermore, the lower-end portion of the switching member 54 is bent so as to form a step retracting rearward. A coupling pin 54P is provided to the lower-end portion such that it protrudes frontward.

Furthermore, a switching knob 56 is fixed to the front face of the switching member 54 such that they can be turned together as a single unit. In the threading state of the threading mechanism 20, upon turning the switching knob 56 in the clockwise direction around the axis of the support shaft 132P in a front view, the contact tab 54C1 of the switching arm 54C of the switching member 54 presses the pin 44P of the slide plate 44 rightward so as to slide the slide plate 44 rightward. Furthermore, with such an arrangement in this state, the engagement arm 54D of the switching member 54 is engaged with the engagement pin 52A of the switching transmission member 52. In this state, the operating shaft 50 is turned in the counterclockwise direction around the axis of the operating shaft 50 itself as viewed from the right side.

On the other hand, in the sewing-enabled state of the threading mechanism 20, upon turning the switching knob 56 in the counterclockwise direction around the axis of the support shaft 132P in a front view, the slide plate 44 is slid leftward by an unshown force-applying member. In this state, the engagement arm 54E of the switching member 54 is engaged with the engagement pin 52A of the switching transmission member 52. The operating shaft 50 is rotated in a clockwise manner around the axis of the operating shaft 50 itself as viewed from the right side.

It should be noted that the threading mechanism 20 is covered by the front cover 134 from the front side such that the switching knob 56 is exposed from the front cover 134 frontward so as to allow the user to operate the switching knob 54 (see FIG. 2).

[Regarding the Main Shaft Fixing Mechanism 60]

As shown in FIG. 3, the main shaft fixing mechanism 60 is configured including a fixing shaft 62 and a main shaft fixing plate 64.

[Regarding the Fixing Shaft 62]

The fixing shaft 62 is configured to have an approximately cylindrical shape with a bottom, with the front-rear direction as the axial direction, and having an opening that faces the rear side. With such an arrangement, a rear-end portion of the fixing shaft 62 is inserted into the insertion opening 132A formed in the unit base 132 such that it can be relatively moved in the front-rear direction. Furthermore, a front-end portion of the fixing shaft 62 is arranged within the large-diameter portion 44B1 formed in the slide plate 44 when it is set to the sewing-enabled position. Furthermore, the fixing shaft 62 is configured such that it is moved in the front-rear direction together with the rotation of the operating shaft 50 described above, which is not shown in the drawings. Specifically, when the operating shaft 50 is rotated in a counterclockwise manner according to the rotation of the switching knob 56 in a clockwise manner, the fixing shaft 62 is moved frontward. Conversely, when the operating shaft 50 is rotated in a clockwise manner according to the rotation of the switching knob 56 in a counterclockwise manner, the fixing shaft 62 is moved rearward.

Furthermore, a groove portion 62A is formed in the outer circumferential portion of the front-end portion of the fixing shaft 62. Specifically, the groove portion 62A is formed over the entire circumferential portion of the fixing shaft 62. With such an arrangement, in the state shown in FIG. 3, when the fixing shaft 62 is moved rearward, the positions of the groove portion 62A and the slide plate 44 coincide with each other along the front-rear direction. In this state, this arrangement allows the slide plate 44 to be slid leftward from the sewing-enabled position. That is to say, the edge portion of the slide opening 44B formed in the slide plate 44 is inserted into the groove portion 62A. In this state, by sliding the slide plate 44 leftward, this arrangement allows the slide plate 44 to be slid from the sewing-enabled position to the threading position.

[Regarding the Main Shaft Fixing Plate 64]

The main shaft fixing plate 64 is configured in an approximately disk-shaped structure with the left-right direction as the thickness direction. The main shaft fixing plate 64 is arranged on the rear side of the fixing shaft 62. The main shaft fixing plate 64 and the main shaft 66 are arranged coaxially with the left-right direction as the axial direction. The main shaft fixing plate 64 is fixed to the main shaft 66 such that it can be rotated as a single unit. It should be noted that, by driving an unshown motor, this arrangement allows the main shaft 66 to be rotated around the axis of the main shaft 66 itself.

A notch 64A is formed in the outer circumferential portion of the main shaft fixing plate 64 such that it has an opening that faces outward in a radial direction of the main shaft fixing plate 64. With such an arrangement, by moving the fixing shaft 62 rearward such that its rear end fits into the notch 64A, this arrangement prevents the rotation of the main shaft fixing plate 64 (i.e., the main shaft 66).

[Regarding the Looper Cover 70]

Figure 4:
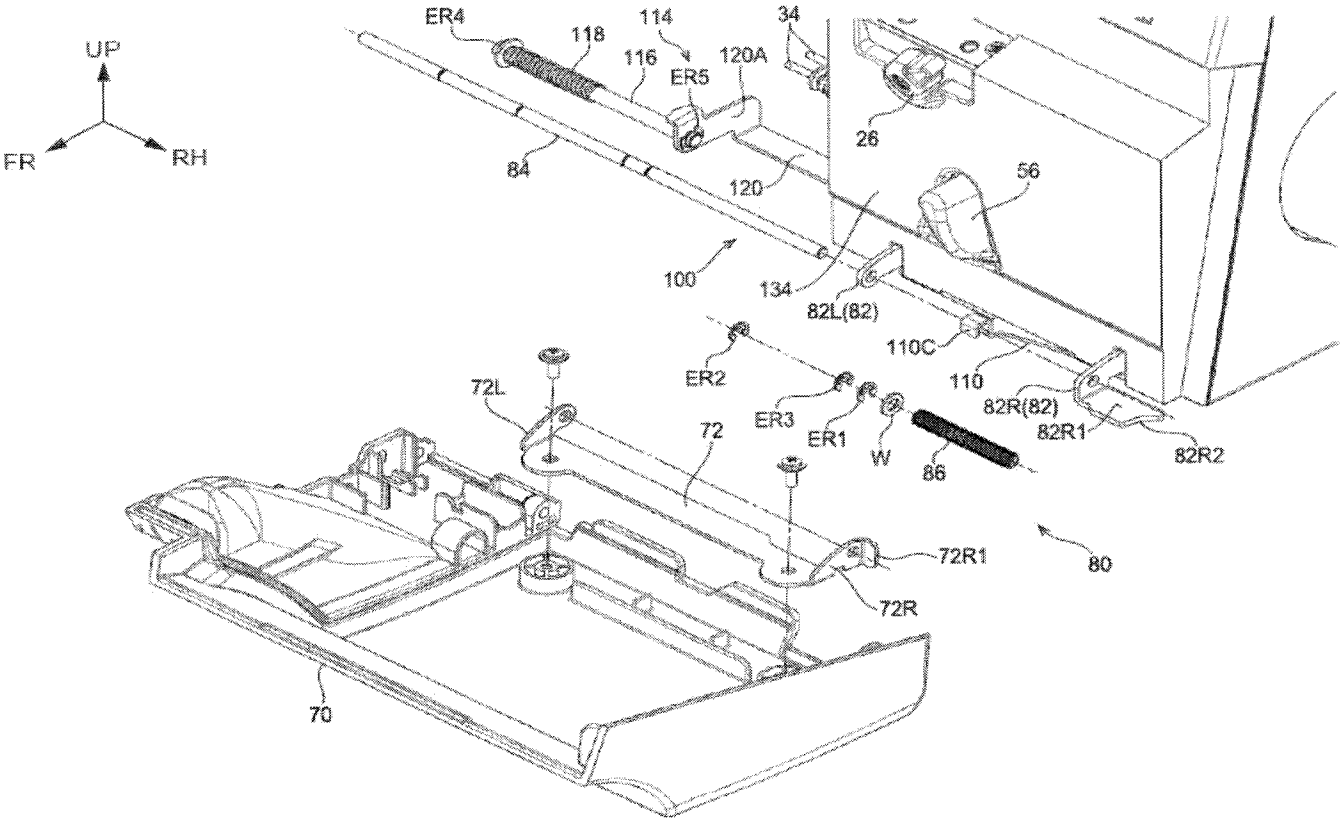
FIG. 4 is an exploded perspective view showing a hinge mechanism and the looper cover shown in FIG. 1.

As shown in FIGS. 1, 2, and 4, the looper cover 70 is arranged as a front portion of the overlock sewing machine 10. Specifically, the looper cover 70 is coupled to a hinge mechanism 80 such that it can be opened and closed on the front side of the front cover 134. Accordingly, first, description will be made regarding the hinge mechanism 80. Next, description will be made regarding the looper cover 70.

The hinge mechanism 80 is configured including a hinge plate 82 configured as a "support member", a hinge shaft 84, and a hinge spring 86 configured as a "shaft force-applying member".

The hinge plate 82 is arranged in a plate shape with the upper-lower direction as the thickness direction, and is arranged below the threading mechanism 20. Furthermore, the hinge plate 82 is fixed to the sewing machine main body 130 at an unshown position. A pair of left and right support portions 82L and 82R are monolithically formed in the front-end portion of the hinge plate 82 such that they are bent upward. The support portions 82L and 82R are arranged with the left-right direction as the thickness direction such that the front-end portions of the support portions 82L and 82R protrude frontward from the front cover 134.

A cam tab 82R1 is provided to the support portion 82R such that it is bent rightward from the lower-end portion of the support portion 82R. The cam tab 82R1 is arranged with the upper-lower direction as the thickness direction. Furthermore, a cam portion 82R2 is formed in the right end of the cam tab 82R1. The cam portion 82R2 is configured in an approximately arc structure such that it is inclined rightward as it extends rearward in a plan view, and such that it protrudes diagonally leftward and rearward.

The hinge shaft 84 is configured in an approximately longitudinal shaft structure with the left-right direction (width direction) as its axial direction. Furthermore, the hinge shaft 84 is supported by the support portions 82L and 82R such that it can be relatively moved in the left-right direction.

The hinge spring 86 is configured as a compression coil spring. The hinge spring 86 is mounted on a right-side portion of the hinge shaft 84 (specifically, a portion of the hinge shaft 84 between the support portions 82L and 82R of the hinge plate 82). With such an arrangement, the right-end portion of the hinge spring 86 is engaged with the support portion 82R. On the other hand, the left-end portion of the hinge spring 86 is engaged with an E-ring ER1 fixed to the hinge shaft 84 via a washer W. With this, the hinge shaft 84 is forced leftward (one direction in the axial direction) by the force applied by the hinge spring 86.

Next, description will be made regarding the looper cover 70. The looper cover 70 is configured in an approximately rectangular structure, and is rotatably coupled to the hinge mechanism 80. It should be noted that description will be made below for convenience assuming that the looper cover 70 is in the open state.

A hinge coupling member 72 having an approximately longitudinal plate structure is fixed to the base-end portion (rear-end portion) of the looper cover 70 such that it extends in the left-right direction with the upper-lower direction as the thickness direction. A pair of hinge portions 72L and 72R are respectively provided to both end portions of the hinge coupling member 72 defined in the longitudinal direction thereof such that they are bent upward. The hinge portions 72L and 72R are arranged with the left-right direction as the thickness direction. Furthermore, a stopper tab 72R1 is formed in the rear-end portion of the hinge portion 72R such that it is bent rightward. The stopper tab 72R1 is arranged with the front-rear direction as the thickness direction.

With such an arrangement, the hinge portions 72L and 72R are rotatably supported by the hinge shaft 84. Furthermore, the left-end portion of the base-end portion of the looper cover 70 is rotatably supported by the hinge shaft 84. Specifically, the hinge portion 72L is arranged in the vicinity of the left side of the support portion 82L of the hinge plate 82. Furthermore, an E-ring ER2 is fixed to the hinge shaft 84 such that it is positioned between the hinge portion 72L and the support portion 82L. With this, upon moving the hinge shaft 84 leftward, the hinge portion 72L is pressed by the E-ring ER2, and the left-end portion of the looper cover 70 is pressed by the hinge shaft 84. This moves the looper cover 70 leftward together with the hinge shaft 84 as a single unit. Conversely, upon moving the looper cover 70 rightward after it is moved leftward, the hinge portion 72L presses the E-ring ER2 rightward, and the left-end portion of the looper cover 70 presses the hinge shaft 84. This moves the hinge shaft 84 rightward together with the looper cover 70.

On the other hand, the hinge portion 72R is arranged on the right side of the support portion 82R. Furthermore, in the open state of the looper cover 70, the hinge portion 72R is arranged on the right side of the cam tab 82R1 of the support portion 82R. In this state, the stopper tab 72R1 is engaged with the cam portion 82R2 of the cam tab 82R1 (at a position of the looper cover 70 shown in FIG. 1, which will be referred to as the "open position" hereafter). Furthermore, as described above, the hinge shaft 84 is forced leftward by the hinge spring 86. Accordingly, the looper cover 70 is held at the open position.

Subsequently, upon rotating the looper cover 70 rearward by approximately 90 degrees from the open position (in the direction indicated by the arrow A shown in FIGS. 1 and 2, which corresponds to the "closed state side" in the present invention), the engagement state between the stopper tab 72R1 and the cam portion 82R2 of the cam tab 82R1 is released, and the stopper tab 72R1 is set to a position above the cam tab 82R1. In this state, the looper cover 70 and the hinge shaft 84 are moved leftward by the force applied by the hinge spring 86. In the description that will be made below, the position at which the looper cover is rotated rearward by approximately 90 degrees from the open position will be referred to as an "interim closed position". Furthermore, the position at which the looper cover 70 is moved leftward from the interim closed position will be referred to as a "completely closed position" hereafter. It should be noted that, when the looper cover is set to the completely closed position, the hinge portion 72R comes in contact with the support portion 82R, which restricts the movement of the looper cover 70 leftward.

[Regarding the Side Cover 90]

Figure 5:
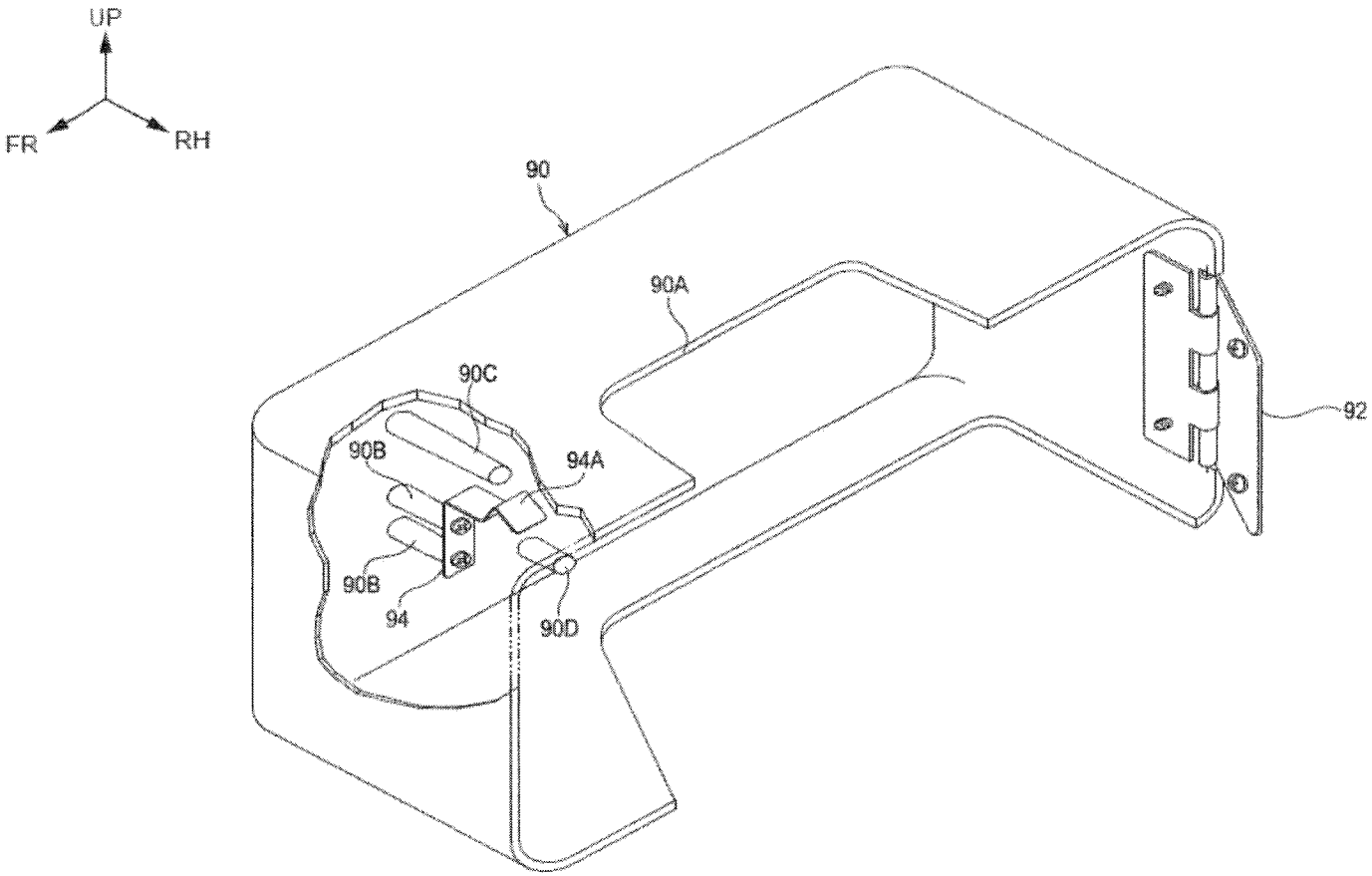
FIG. 5 is a perspective view showing a side cover employed in the overlock sewing machine shown in FIG. 2.

As shown in FIGS. 2, 5, and 6, the side cover 90 is arranged as a left-side portion of the overlock sewing machine 10. The side cover 90 is configured in an approximately box structure having an opening that faces the right side. The side cover 90 is arranged on the left side (one side in the left-right direction) with respect to the looper cover 70 and the threading mechanism 20 (which are not shown in FIGS. 5 and 6). With such an arrangement, the opening portion defined in the rear wall of the side cover 90 is fixed to the sewing machine main body 130 via a hinge portion 92. Specifically, the side cover 90 is coupled to the sewing machine main body 130 such that it is switchable between the open state and the closed state with the upper-lower direction as its axial direction.

A housing portion 90A is formed in the opening portion defined in the upper wall of the side cover 90 such that it has an opening that faces the right side. Such an arrangement allows the needle plate 136 of the sewing machine main body 130 to be housed in the housing portion 90A. A pair of upper and lower fixing portions 90B each having an approximately cylindrical structure are formed in the left-side wall of the side cover 90 such that they protrude toward the opening side of the side cover 90. Furthermore, an engagement member 94 configured as a plate spring is provided on the opening side of the side cover 90 with respect to the fixing portions 90B. The engagement member 94 is configured in an approximately inverted L-shaped structure as viewed in a front view. The lower portion of the engagement member 94 is fixed to the fixing portions by screwing by screws. Furthermore, a hook portion 94A is formed in the end portion of the upper-end side of the engagement member 94 such that it protrudes upward.

On the other hand, a reception plate 96 that corresponds to the engagement member 94 is provided to the left side of the sewing machine main body 130. The reception plate 96 is configured in an approximately hat-shaped structure having an opening that faces the right side as viewed in a plan view. Both ends of the reception plate 96 defined in the longitudinal direction are fixed to the sewing machine main body 130 by screwing. With such an arrangement, in the closed state of the side cover 90, the hook portion 94A of the engagement member 94 is engaged with the lower face of the top wall of the reception plate 96. This allows the closed state of the side cover 90 to be maintained (see FIG. 7B).

Furthermore, a stopper 90C having an approximately cylindrical structure is provided to the left-side wall of the side cover 90 such that it is positioned above the fixing portions 90B. The stopper 90C is configured such that it protrudes from the left-side wall of the side cover toward the opening side thereof. With such an arrangement, when the side cover 90 is closed, the stopper 90C comes in contact with the reception plate 96, thereby restricting the rotation of the side cover 90.

Furthermore, a detection shaft pressing portion 90D is provided to the left-side wall of the side cover 90 such that it is positioned below the stopper 90C in order to press a cover detection shaft 116 described later. The detection shaft pressing portion 90D is configured in an approximately cylindrical structure such that it protrudes from the left-side wall of the side cover 90 toward the opening side thereof.

[Regarding the Safety Mechanism 100]

As shown in FIGS. 1 and 3, the safety mechanism 100 is configured including a detection base 102 configured as a "switch fixing member", a switch 108, a looper cover detection member 110, a side cover detection member 114, and a detection lever 124 configured as a "lever".

[Regarding the Detection Base 102]

The detection base 102 is configured in an approximately L-shaped structure as viewed from the left side. Specifically, the detection base 102 includes a guide plate portion 102A configured to guide the looper cover detection member 110 and the side cover detection member 114 described later. The guide plate portion 102A is arranged with the upper-lower direction as the thickness direction. Furthermore, the detection base 102 includes a fixing plate portion 102B configured such that it extends upward from the rear-end portion of the guide plate portion 102A. With such an arrangement, the fixing plate portion 102B is fixed to the unit base 132 by screwing on the lower-right side of the threading switching mechanism 40.

A first guide opening 102C (which is regarded in a broad sense as a "guide portion") is formed as a through hole in the left-side portion of the front-end portion of the guide plate portion 102A such that it extends in a linear fashion in the left-right direction. Furthermore, a second guide opening 102D (which is regarded in a broad sense as a "guide portion") is formed as a through hole in the right-side portion of the rear-end portion of the guide plate portion 102A such that it extends in a linear fashion in the left-right direction. The second guide opening 102D is designed to have a length in the longitudinal direction that is shorter than that of the first guide opening 102C.

Furthermore, a switch fixing portion 102 is formed in the right-end portion of the fixing plate portion 102B such that it is bent rearward. The switch fixing portion 102E is arranged with the left-right direction as the thickness direction. Moreover, a switch fixing base 106 is arranged adjacent to the right side of the switch fixing portion 102E, which is configured to fix the switch 108 described later. The switch fixing base 106 is formed of an insulating material, and is fixed to the switch fixing portion 102E by screwing.

[Regarding the Switch 108]

The switch 108 is configured to have an approximately rectangular block-shaped structure. The switch 108 is arranged on the lower side of the front-end portion of the switch fixing plate 106, and is fixed to the switch fixing base 106 by screwing. With this, the switch 108 is fixed to the detection base 102 via the switch fixing base 106. The switch 108 includes an operating protrusion 108A. The operating protrusion 108A is configured such that it protrudes frontward from the front face of the switch 108. With such an arrangement, when the operating protrusion 108A is pressed rearward, the switch 108 is operated. Specifically, when the operating protrusion 108A is pressed, the switch 108 is set to an ON state. In this state, this enables a motor (not shown) for driving the main shaft 66 to be driven (the motor power supply is set to an on state). In contrast, when the operating protrusion 108A is not pressed such that it protrudes, the switch 108 is set to an OFF state. In this state, the motor is set to the driving-disabled state (the motor power supply is set to a disconnection state).

[Regarding the Looper Cover Detection Member 110]

The looper cover detection member 110 is arranged between the detection base 102 and the hinge shaft 84. Furthermore, the looper cover detection member 110 is configured in an approximately L-shaped plate structure as viewed from the left side. Specifically, the looper cover detection member 110 is configured including a base plate portion 110A configured with the upper-lower direction as the thickness direction, and a switching plate portion 110B configured such that it extends upward from the rear-end portion of the base plate portion 110A.

A hinge shaft linkage portion 110C configured as an "engagement portion" is monolithically formed in the front-end portion of the left-end portion of the base plate portion 110A. The hinge shaft linkage portion 110C is configured such that it is bent in an approximately inverted U-shaped structure having an opening that faces the lower side as viewed in the left-right direction. With such an arrangement, the hinge shaft 84 is arranged within the hinge shaft linkage portion 110C so as to couple the hinge shaft linkage portion 110C and the hinge shaft 84 such that they can be moved as a single unit in the left-right direction. Specifically, the E-ring ER1 described above is arranged adjacent to the right side of the hinge shaft linkage portion 110C. On the other hand, an E-ring ER3 fixed to the hinge shaft 84 is arranged adjacent to the left side of the hinge shaft linkage portion 110C. With this, when the hinge shaft 84 and the looper cover 70 are to be moved in the left-right direction, the hinge shaft linkage portion 110C is engaged with the hinge shaft 84 via the E-rings ER1 and ER3. This arrangement allows the hinge shaft linkage portion 110C (that is, the looper cover detection member 110) to be moved together with the hinge shaft 84 and the looper cover 70 in the left-right direction.

With such an arrangement, the position of the looper cover detection member 110 when the looper cover 70 is at the open position is designed as a non-switching position. When the looper cover 70 is set to the completely closed position, the looper cover detection member 110 is moved leftward from the non-switching position, and is set to the switching position.

The switching plate portion 110B is configured in an approximately U-shaped structure having an opening that faces the upper side as viewed in a front view. The upper-end portion of the right-end portion of the switching plate portion 110B is configured such that it is bent rearward by approximately 90 degrees, and is arranged adjacent to the lower side of the guide plate portion 102A of the detection base 102. Furthermore, a guide pin 112 is provided to the upper-end portion as a "second pin" having a cylindrical structure. The guide pin 112 is configured such that it protrudes upward from the upper-end portion, and is inserted into the first guide opening 102C of the detection base 102 such that it can be relatively moved. With this arrangement, the movement of the looper cover detection member 110 in the left-right direction is guided by the first guide opening 102C of the detection base 102.

Furthermore, the upper-end portion of the left-end portion of the switching plate portion 110B is configured as a pressing portion 110D. The pressing portion 110D is arranged on the right side of the coupling pin 54P of the switching member 54. With such an arrangement, when the looper cover detection member 110 is moved from the non-switching position to the switching position in the threading state of the threading mechanism 20, the pressing portion 110D presses the coupling pin 54P of the switching member 54 leftward, thereby rotating the switching member 54 in a clockwise manner as viewed in the front view. With this, the slide plate 44 is moved from the threading position to the sewing-enabled position, thereby switching the threading mechanism 20 from the threading state to the sewing-enabled state.

[Regarding the Side Cover Detection Member 114]

The side cover detection member 114 is configured including a cover detection shaft 116, a detection spring 118 configured as a "force-applying member", and a cover detection rod 120.

[Regarding the Cover Detection Shaft 116]

As shown in FIG. 6, the cover detection shaft 116 is inserted into a through hole 130A formed in the sewing machine main body 130 such that it can be relatively moved with the left-right direction as its axial direction. Furthermore, the cover detection shaft 116 is arranged coaxially with the detection shaft pressing portion 90D when the side cover 90 is in the closed state (see FIG. 7B). Furthermore, in a state in which the cover detection shaft 116 is inserted into the sewing machine main body 130, the left-side portion of the cover detection shaft 116 is arranged such that it protrudes leftward with respect to the sewing machine main body 130. Furthermore, the right-end portion of the cover detection shaft 116 is arranged such that it protrudes rightward with respect to the sewing machine main body 130.

[Regarding the Detection Spring 118]

The detection spring 118 is configured as a compression coil spring. The detection spring 118 is mounted on the left-side portion of the cover detection shaft 116 (specifically, a portion of the cover detection shaft 116 that protrudes leftward with respect to the sewing machine main body 130). The left-end portion of the detection spring 118 is engaged by an E-ring ER4 fixed to the left-end portion of the cover detection shaft 116. The right-end portion of the detection spring 118 is engaged with the sewing machine main body 130. Furthermore, in a state in which the detection spring 118 is mounted on the cover detection shaft 116, the detection spring 118 is compressed such that its shape is changed. With this, the cover detection shaft 116 is forced leftward by the detection spring 118.

[Regarding the Cover Detection Rod 120]

As shown in FIGS. 1 and 3, the cover detection rod 120 is configured in an approximately longitudinal plate structure that extends in the left-right direction with the upper-lower direction as the thickness direction. The cover detection rod 120 is arranged on the right side of the cover detection shaft 116. A coupling tab 120A is formed as a left-end portion of the cover detection rod 120 such that it is bent upward. A circular coupling opening 120B is formed as a through hole in the coupling tab 120A. With such an arrangement, the right-end portion of the cover detection shaft 116 is inserted into the coupling opening 120B. In this state, the coupling tab 120A is arranged such that it is interposed between a pair of E-rings ER5 fixed to the cover detection shaft 116 along the left-right direction. With this, the cover detection shaft 116 and the cover detection rod 120 are coupled such that they can be moved as a single unit in the left-right direction.

Figure 7B:
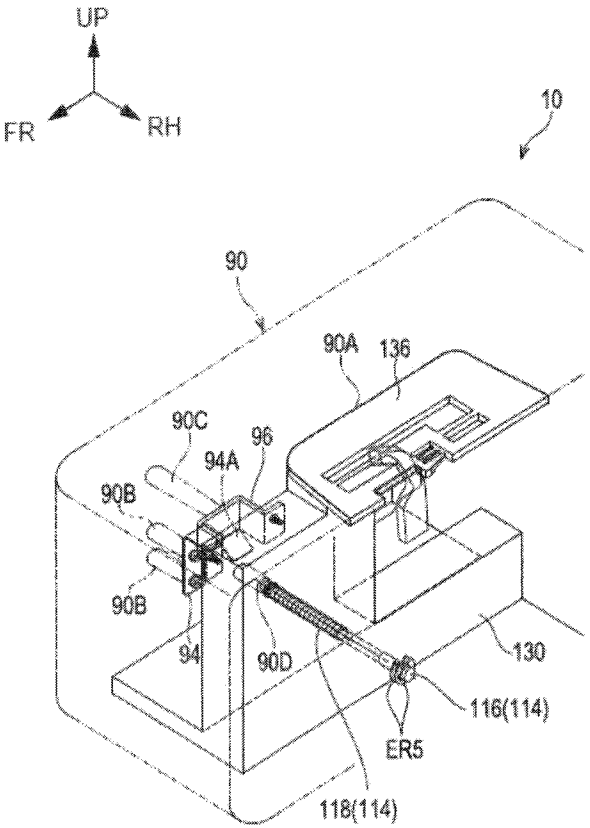
FIG. 7B is a perspective view showing a state after the side cover is closed.
Figure 7A:
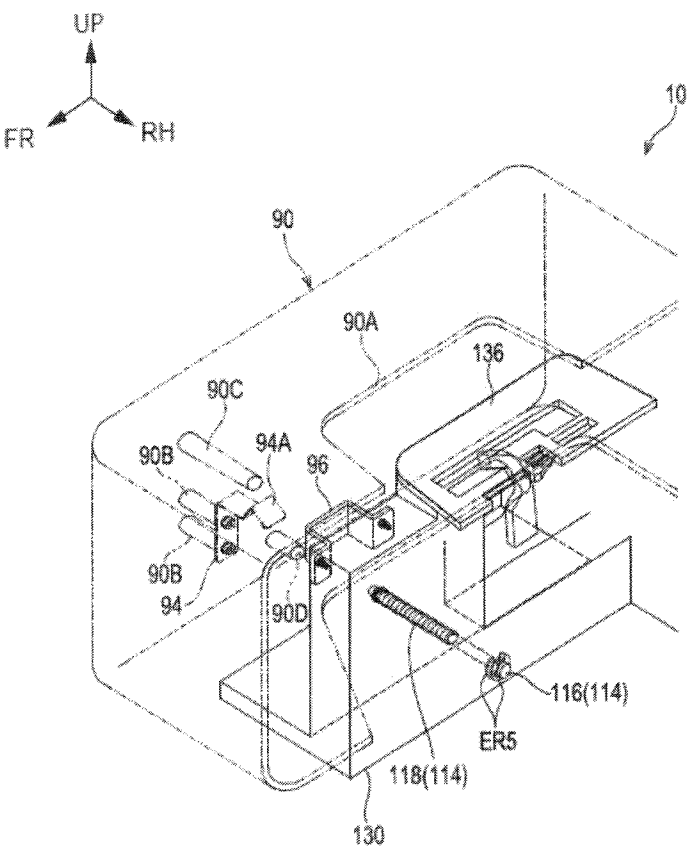
FIG. 7A is a perspective view showing a state before the side cover shown in FIG. 5 is closed.

With such an arrangement, as shown in FIG. 7A, in a state in which the side cover 90 is opened, the detection shaft pressing portion 90D of the cover 90 is moved away leftward with respect to the cover detection shaft 116, and the E-ring ER5 comes in contact with the right-side face of the sewing machine main body 130 by the force applied by the detection spring 118. This maintains the position of the cover detection shaft 116 (i.e., the position of the side cover detection member 114) (the position of the side cover detection member 114 will be referred to as a "non-detection position"). In contrast, in a state in which the side cover 90 is closed as shown in FIG. 7B, the detection shaft pressing portion 90D presses the left end of the cover detection shaft 116 rightward against the force applied by the detection spring 118, thereby moving the cover detection shaft 116 (i.e., the side cover detection member 114) rightward from the non-detection position (the position of the side cover detection member 114 will be referred to as a "detection position" hereafter).

As shown in FIGS. 1 and 3, the cover detection rod 120 is configured such that its intermediate portion in the longitudinal direction is bent in an approximately crank shape. The right-end portion of the cover detection rod 120 is arranged above the guide plate portion 102A of the detection base 102 with a gap between them. A guide pin 122 configured as a "first pin" is provided to the right-end portion of the cover detection rod 120. The guide pin 122 is configured in an approximately cylindrical structure such that it protrudes downward from the right-end portion of the cover detection rod 120. With such an arrangement, the guide pin 122 is inserted into the second guide opening 102D of the detection base 102 such that it can be relatively moved. This allows the second guide opening 102D to guide the movement of the cover detection rod 120 between the non-detection position and the detection position. It should be noted that the tip portion (lower-end portion) of the guide pin 122 is arranged such that it protrudes downward from the guide plate portion 102A. An E-ring ER6 is fixed to the tip portion of the guide pin 122. This prevents the guide pin 122 from detaching from the second guide opening 102D.

[Regarding the Detection Lever 124]

The detection lever 124 is configured in an approximately longitudinal plate structure that extends in the left-right direction with the upper-lower direction as the thickness direction. The detection lever 124 is arranged between the guide plate portion 102A of the detection base 102 and the right-end portion of the cover detection rod 120. A circular coupling opening 124A is formed as a through hole in an intermediate portion in the rear-end portion of the detection lever 124 in the longitudinal direction. With such an arrangement, the guide pin 122 of the cover detection rod 120 is inserted into the coupling opening 124A such that it can be relatively rotated. With this arrangement, the detection lever 124 is configured such that it can be moved together with the cover detection rod 120 as a single unit in the left-right direction.

Furthermore, a cam opening 124B configured as a "cam groove" is formed as a through hole in the left-side portion of the detection lever 124 (specifically, a left-side portion with respect to the coupling opening 124A). The cam opening 124B is configured such that it is positioned on the left side and on the front side with respect to the coupling opening 124A and such that it extends in the left-right direction. Furthermore, the cam opening 124B is configured such that its left-side portion is bent rearward in an approximately crank shape. Specifically, the cam opening 124B is configured including a first cam opening portion 124B1 configured as the left-end portion of the cam opening 124B such that it extends in the left-right direction, an inclined cam opening portion 124B2 configured such that it is inclined frontward as it approaches the right side from the right-end portion of the first cam opening portion 124B1, and a second cam opening portion 124B3 configured such that it extends rightward from the right-end portion of the inclined cam opening portion 124B2.

With such an arrangement, the guide pin 112 of the looper cover detection member 110 is inserted into the cam opening 124B such that it can be relatively moved. With this, the position of the guide pin 112 of the detection lever 124 is changed in a range in the left-right direction defined by the cam opening 124B according to the relative position between the looper cover detection member 110 and the side cover detection member 114 in the left-right direction. This changes the orientation of the detection lever 124. It should be noted that the guide pin 112 is arranged such that its tip portion (upper-end portion) protrudes upward from the detection lever 124. An E-ring ER7 is fixed to the upper-end portion of the guide pin 112. This arrangement prevents the guide pin 112 from detaching from the cam opening 124B.

Furthermore, a switch pressing portion 124C is monolithically formed as a right-end portion of the detection lever 124 such that it protrudes downward. The switch pressing portion 124C is configured to press the operating protrusion 108A of the switch 108.

With such an arrangement, when both the looper cover 70 and the side cover 90 are in an open state, the detection lever 124 is arranged on the left side of the switch 108. Furthermore, the switch pressing portion 124C is arranged such that it is positioned on the left side and the front side with respect to the operating protrusion 108A of the switch 108 with a gap between them. That is to say, the switch 108 is set to the OFF state.

Furthermore, with such an arrangement, when both the looper cover 70 and the side cover 90 are in a closed state, the switch pressing portion 124C presses the operating protrusion 108A so as to set the switch 108 to the ON state, which will be described later in detail. Moreover, with such an arrangement, when either the looper cover 70 or the side cover 90 is in an open state, the switch pressing portion 124C does not press the operating protrusion 108A. In this state, the switch 108 is set to the OFF state.

[Operations and Effects]

Next, description will be made below regarding the operations and effects with reference to the operations of the safety mechanism 100 in four kinds of states, i.e., states 1 through 4.

[Regarding the State 1]

In the state 1, both the looper cover 70 and the side cover 90 are in an open state. In this state, the looper cover 70 is in an open state. Accordingly, the hinge portion 72R of the looper cover 70 is arranged on the right side of the cam tab 82R1 of the support portion 82R of the hinge plate 82. Furthermore, the stopper tab 72R1 is engaged with the cam portion 82R2 of the cam tab 82R1. Accordingly, the looper cover 70 is maintained at the open position.

With such an arrangement, when the looper cover 70 is set to the open position, the looper cover detection member 110 is set to the non-switching position. Specifically, as shown in FIG. 8A, the guide pin 112 of the looper cover detection member 110 is arranged at the right-end portion of the cam opening 124B (second cam opening portion 124B3) of the detection lever 124.

Furthermore, in the state 1, the side cover 90 is also in the open state. Accordingly, as shown in FIG. 7A, the detection shaft pressing portion 90D of the side cover 90 is arranged on the left side of the cover detection shaft 116 of the side cover detection member 114 with a gap between them. With this, the side cover detection member 114 is arranged at the non-detection position by the force applied by the detection spring 118.

Figure 8A:
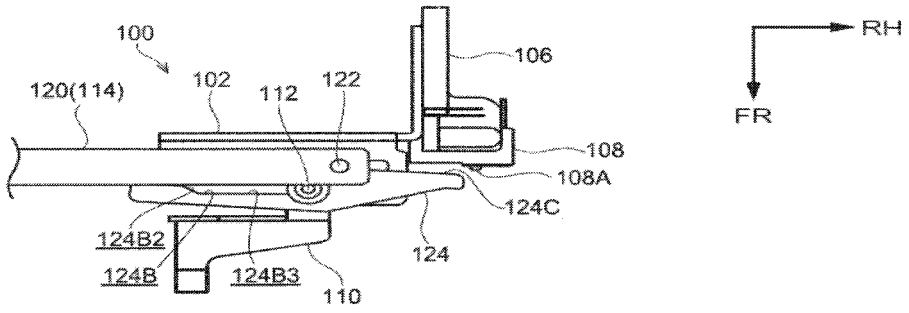
FIG. 8A is a plan view showing a position relation between a detection lever of a safety mechanism and a switch in a state in which both the looper cover and the side cover are opened.

With such an arrangement, as shown in FIG. 8A, when the looper cover detection member 110 is set to the non-switching position, and when the side cover detection member 114 is set to the non-detection position, the detection lever 124 is arranged such that it is positioned on the left side of the operating protrusion 108A of the switch 108 and such that it is inclined somewhat frontward toward the right side. In this state, the second cam opening portion 124B3 extends along the left-right direction. More specifically, the switch pressing portion 124C of the detection lever 124 is arranged such that it is positioned on the left side and the front side of the operating protrusion 108A of the switch 108 with a gap between them. Accordingly, the switch 108 is set to the OFF state, and the motor power supply is set to the disconnection state.

[Regarding the State 2]

In the state 2, the looper cover 70 is set to the closed state, and the side cover 90 is set to the open state. That is to say, the state 2 is the same as the state 1 except that the looper cover 70 is switched from the open state to the closed state. With such an arrangement, when the looper cover 70 is to be switched from the open state to the closed state, the looper cover 70 is turned rearward from the open position thereof so as to set the looper cover 70 to the interim closed position. Subsequently, the looper cover 70 is moved leftward from the interim closed position, thereby setting the looper cover 70 to the completely closed position.

Specifically, upon turning the looper cover 70 from the open position to the interim closed position, the engagement state between the stopper tab 72R1 of the looper cover 70 and the cam portion 82R2 of the cam tab 82R1 of the hinge plate 82 is released. With this, the looper cover 70 and the hinge shaft 84 are moved leftward by the force applied by the hinge spring 86, thereby setting the looper cover 70 to the completely closed position.

Furthermore, when the looper cover 70 and the hinge shaft 84 are moved leftward, the hinge shaft linkage portion 110C of the looper cover detection member 110 is moved leftward in conjunction with the hinge shaft 84 and the looper cover 70, thereby moving the looper cover detection member 110 to the switching position.

Figure 8B:
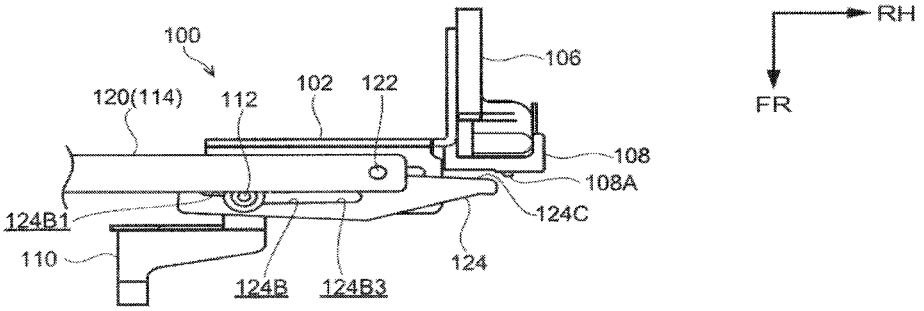
FIG. 8B is a plan view showing a position relation between the detection lever and the switch in a state in which the looper cover is closed and the side cover is opened.

In contrast, in the state 2, the side cover 90 is in the open state. The left-right position of the side cover detection member 114 matches that in the state 1. Furthermore, the guide pin 122 of the cover detection rod 120 included in the side cover detection member 114 is coupled to the coupling opening 124A of the detection lever 124 such that it can be relatively rotated. Accordingly, the left-right position of the detection lever 124 also matches that in the state 1. That is to say, the point of difference between the state 2 and the state 1 is that, in the state 2, the looper cover detection member 110 is relatively displaced leftward with respect to the detection lever 124 while maintaining the position of the detection lever 124 in the left-right direction. Specifically, as shown in FIG. 8B, the guide pin 112 of the looper cover detection member 110 is moved leftward along the longitudinal direction (left-right direction) of the second cam opening portion 124B3 from the right-end portion of the cam opening 124B (second cam opening portion 124B3) included in the detection lever 124. With such an arrangement, when the looper cover detection member 110 is in the switching position, the guide pin 112 is arranged at the right-end portion of the inclined cam opening portion 124B2 of the cam opening 124B included in the detection lever 124.

Accordingly, in the state 2, the same position and the same orientation are maintained with respect to the detection lever 124 as in the state 1. Accordingly, the switch pressing portion 124C of the detection lever 124 is maintained on the left side and the front side of the operating protrusion 108A of the switch 108 with a gap between them. Accordingly, as in the state 1, the switch 108 is set to the OFF state, and the motor power supply is set to the disconnection state.

[Regarding the State 3]

In the state 3, the looper cover 70 is set to the open state, and the side cover 90 is set to the closed state. That is to say, the state 3 is the same as the state 1 except that the side cover 90 is switched from the open state to the closed state. Upon switching the side cover 90 from the open state to the closed state, as shown in FIG. 7B, the detection shaft pressing portion 90D of the side cover 90 presses the left end of the cover detection shaft 116 included in the side cover detection member 114 rightward against the force applied by the detection spring 118. With this, the cover detection shaft 116 (side cover detection member 114) is moved from the non-detection position rightward, thereby setting the cover detection shaft 116 to the detection position.

Figure 8C:
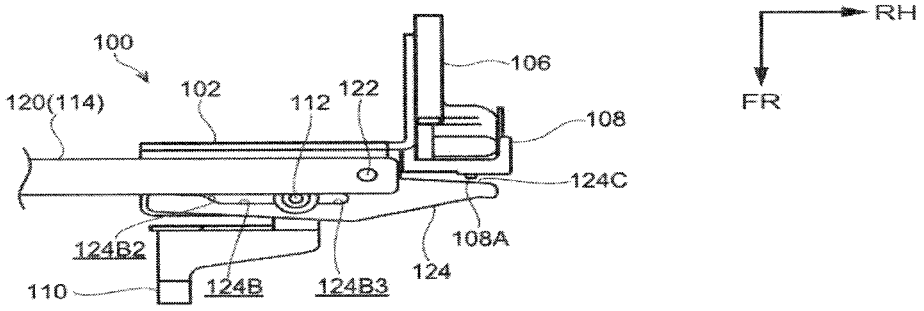
FIG. 8C is a plan view showing a position relation between the detection lever and the switch in a state in which the looper cover is opened and the side cover is closed.

As shown in FIG. 8C, when the side cover detection member 114 is moved rightward, the guide pin 122 of the cover detection rod 120 is moved rightward along the second guide opening 102D (not shown in FIG. 8C) formed in the detection base 102. With such an arrangement, the guide pin 122 is coupled to the coupling opening 124A of the detection lever 124 such that it can be relatively rotated. Accordingly, the detection lever 124 is moved rightward together with the guide pin 122.

In contrast, in the state 3, the looper cover 70 is set to the open state. Accordingly, the left-right position of the looper cover detection member 110 matches that in the state 1. That is to say, the looper cover detection member 110 is set such that it is positioned at the non-switching position. Accordingly, the difference between the state 3 and the state 1 is that the detection lever 124 is relatively displaced rightward with respect to the looper cover detection member 110 while maintaining the position of the looper cover detection member 110. That is to say, the detection lever 124 is moved rightward together with the cover detection rod 120 while relatively displacing the cam opening 124B of the detection lever 124 rightward with respect to the guide pin 112 of the looper cover detection member 110. Specifically, the guide pin 112 of the looper cover detection member 110 is relatively displaced from the right-end portion of the second cam opening portion 124B3 to an intermediate portion of the second cam opening portion 124B3 defined in the longitudinal direction. With this, the detection lever 124 is moved rightward in parallel with respect to the first state 1. That is to say, in the state 3, the detection lever 124 is moved rightward while maintaining the switch pressing portion 124C of the detection lever 124 such that it is positioned on the front side of the operating protrusion 108A of the switch 108 with a gap between them.

Accordingly, in the state 3, the switch pressing portion 124C of the detection lever 124 is positioned on the front side of the operating protrusion 108A of the switch 108. However, the switch pressing portion 124C is arranged on the front side of the operating protrusion 108A with a gap between them. Accordingly, in the state 3, as in the state 1, the switch 108 is set to the OFF state, and the motor power supply is set to the disconnection state.

[Regarding the State 4]

In the state 4, the looper cover 70 and the side cover 90 are set to the closed state. In this state, the looper cover detection member 110 is set to the switching position as in the state 2. Furthermore, the side cover detection member 114 is set to the detection position as in the state 3. That is to say, the looper cover detection member 110 is relatively displaced leftward with respect to the detection lever 124 while displacing the detection lever 124 rightward together with the side cover detection member 114.

Figure 8D:
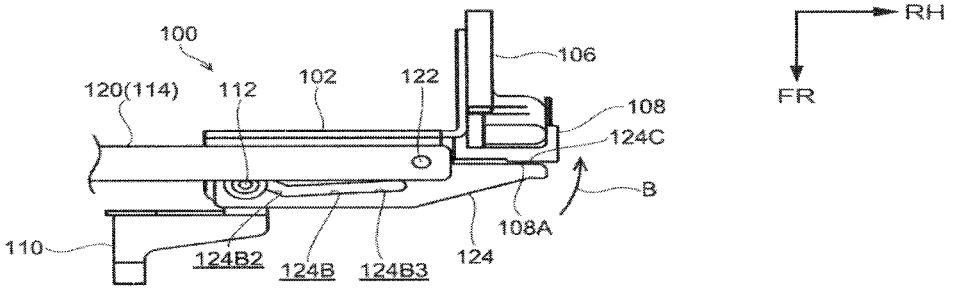
FIG. 8D is a plan view showing a position relation between the detection lever and the switch in a state in which both the looper cover and the side cover are closed.

Subsequently, as shown in FIG. 8D, when the looper cover detection member 110 is set to the switching position, and when the side cover detection member 114 is set to the detection position, the guide pin 112 of the looper cover detection member 110 is moved in a range defined by the cam opening 124B of the detection lever 124 from the second cam opening portion 124B3 to the first cam opening portion 124B1 (not shown in FIG. 8D) via the inclined cam opening portion 124B2. With this, when the guide pin 112 is moved in a range defined by the cam opening 124B, the guide pin 112 presses the inner circumferential face of the inclined cam opening portion 124B2. Accordingly, as viewed in a plan view, the detection lever 124 is swung (turned) toward the side indicated by the arrow B shown in FIG. 8D with the guide pin 122 as the center of rotation. Specifically, the switch pressing portion 124C of the detection lever 124 is displaced rearward (in a direction in which it approaches the operating protrusion 108A of the switch 108) in a state in which it is arranged on the front side of the operating protrusion 108A of the switch 108.

As a result, in the state 4, the switch pressing portion 124C of the detection lever 124 presses the operating protrusion 108A of the switch 108 rearward. This sets the switch 108 to the ON state, and sets the motor power supply to the on state.

Furthermore, when the looper cover detection member 110 is moved to the switching position, the pressing portion 110D of the looper cover detection member 110 comes in contact with the coupling pin 54P of the switching member 54 included in the threading mechanism 20 in the threading state. In this state, the pressing portion 110D presses the coupling pin 54P leftward. Accordingly, the switching member 54 is rotated in a clockwise manner as viewed in a front view. In this state, the slide plate 44 is slid from the threading position to the sewing-enabled position. With this, the threading mechanism 20 is switched from the threading state to the sewing-enabled state.

As described above, with the overlock sewing machine 10 according to the present embodiment, when the looper cover 70 is switched from the open state to the closed state, the looper cover detection member 110 is operated by the looper cover 70 such that it is moved from the non-switching position to the switching position. With such an arrangement, after the looper cover detection member 110 is set to the switching position, the switching member 54 is operated by the looper cover detection member 110, thereby switching the threading mechanism 20 from the threading state to the sewing-enabled state. With this, after the looper cover 70 is set to the closed state, such an arrangement allows the threading mechanism 20 to be set to the sewing-enabled state.

When the side cover 90 is switched from the open state to the closes state, the side cover detection member 114 is operated by the side cover 90 such that it is moved from the non-detection position to the detection position. Furthermore, when the looper cover detection member 110 is moved to the switching position and when the side cover detection member 114 is moved to the detection position, the detection lever 124 is switched from the non-pressing state to the pressing state. In this state, the detection lever 124 presses the operating protrusion 108A. This arrangement allows the switch 108 to detect both the closed state of the looper cover 70 and the closed state of the side cover 90. That is to say, when the closed state of the looper cover 70 and the closed state of the side cover 90 are detected by the switch 108, the threading mechanism 20 is always set to the sewing-enabled state. Accordingly, this arrangement allows the switch 108 to further detect the sewing-enabled state of the threading mechanism 20.

As described above, such an arrangement requires only the single switch 108 to detect the sewing-enabled state of the threading mechanism 20, the closed state of the looper cover 70, and the closed state of the side cover 90. That is to say, such an arrangement requires only the single switch 108 to detect the open/closed state of the looper cover 70, the open/closed state of the side cover 90, and the threading switching state.

Furthermore, the detection lever 124 is coupled to the side cover detection member 114 by the guide pin 122 such that it can be relatively rotated. When the side cover detection member 114 is moved from the non-detection position toward the other side (right side) in the axial direction of the hinge shaft 84, the detection lever 124 is displaced to the detection position. This arrangement allows the detection lever 124 to be displaced in the left-right direction according to the movement of the side cover detection member 114 in the left-right direction. This allows the detection lever 124 to be pressed in contact with and to be moved away from the switch 108 arranged on the right side of the detection lever 124.

Furthermore, the guide pin 112 of the looper cover detection member 110 is inserted into the cam opening 124B of the detection lever 124 such that it can be relatively moved. When the looper cover 70 is moved from the non-switching position toward one side (left side) in the axial direction of the hinge shaft 84, the detection lever 124 is moved to the switching position. Accordingly, this arrangement allows the detection lever 124 to be swung (turned) with respect to the switch 108 (operating protrusion 108A) according to the relative position relation between the side cover detection member 114 and the looper cover detection member 110. With this, as described above, by arranging the detection lever 124 in the vicinity of the switch 108, and by allowing the detection lever 124 to be swung with respect to the switch 108, this arrangement allows the detection lever 124 to be switched between the pressing state and the non-pressing state. As described above, this arrangement requires only a simple configuration to switch the detection lever 124 between the pressing state and the non-pressing state.

Furthermore, the cover detection shaft 116 of the side cover detection member 114 is forced leftward by the force applied by the detection spring 118. With such an arrangement, when the side cover 90 is switched from the open state to the closed state, the cover detection shaft 116 is pressed by the detection shaft pressing portion 90D of the side cover 90, thereby moving the side cover detection member 114 from the non-detection position to the detection position. Accordingly, when the side cover 90 is opened from the closed state, this arrangement allows the side cover detection member 114 to be automatically moved from the detection position to the non-detection position by the force applied by the detection spring 118. This allows the side cover detection member 114 to be switched between the non-detection position and the detection position according to the open/closed state of the side cover 90.

Furthermore, the switch 108 is fixed to the detection base 102 via the switch fixing base 106. Furthermore, the first guide opening 102C is formed in the guide plate portion 102A of the detection base 102. The guide pin 112 of the looper cover detection member 110 is slidably coupled to the first guide opening 102C. Furthermore, the second guide opening 102D is formed in the guide plate portion 102A. The guide pin 122 of the side cover detection member 114 is slidably coupled to the second guide opening 102D. Accordingly, by using the detection base 102 configured to fix the switch 108, this arrangement is capable of guiding the movement of the looper cover detection member 110 and the side cover detection member 114 in the left-right direction.

Furthermore, the guide pin 112 of the looper cover detection member 110 and the guide pin 122 of the side cover detection member 114 are coupled to the detection base 102. Accordingly, this arrangement allows the detection lever 124 to be coupled to the detection base 102 via the guide pins 112 and 122. With this, using the detection base 102 configured to fix the switch 108, this arrangement is capable of stabilizing the orientation (state) of the detection lever 124 to be switched between the pressing state and the non-pressing state.

Furthermore, the hinge shaft linkage portion 110C is monolithically formed in the looper cover detection member 110. The hinge shaft 84 is arranged within an inner space defined by the hinge shaft linkage portion 110C. With such an arrangement, when the hinge shaft 84 and the looper cover are moved in the left-right direction, the hinge shaft linkage portion 110C engaged with the hinge shaft 84 via the E-rings ER1 and ER3 is moved in the left-right direction. This arrangement allows the hinge shaft linkage portion 110C (i.e., the looper cover detection member 110) to be moved in the left-right direction in conjunction with the hinge shaft 84 and the looper cover 70.

Furthermore, the cam tab 82R1 is provided to the support portion 82R of the hinge mechanism 80, and the cam portion 82R2 is formed in the right end of the cam tab 82R1. With such an arrangement, when the looper cover 70 is set to the open state, the hinge portion 72R of the looper cover 70 is arranged on the right side of the cam tab 82R1 of the support portion 82R. In this state, the stopper tab 72R1 is engaged with the cam portion 82R2 of the cam tab 82R1. Accordingly, this arrangement allows the looper cover 70 to be held at the open position.

Furthermore, upon rotating the looper cover 70 from the open position to the interim closed position, the engagement state between the stopper tab 72R and the cam portion 82R2 of the cam tab 82R1 is released, thereby enabling the looper cover 70 to be moved leftward. Accordingly, after the looper cover 70 reaches the interim closed position, the looper cover 70 is automatically slid (moved) from the interim closed position to the completely closed position by the force applied by the hinge spring 86. Accordingly, this arrangement provides improved convenience for the user.

It should be noted that, with the present embodiment, after the looper cover 70 reaches the interim closed position from the open position, the looper cover 70 is moved from the interim closed position to the completely closed position by the force applied by the hinge spring 86. Also, the looper cover 70 may be moved from the interim closed position to the completely closed position by a combination of the force applied by the hinge spring 86 and the operating force applied by the operator.

Description has been made in the present embodiment regarding an arrangement in which the switch 108 is fixed to the detection base 102 via the switch fixing base 106. Also, the switch 108 may be directly fixed to the detection base 102 formed of an insulating material.

Description has been made in the present embodiment regarding an arrangement in which the guide pin 122 is provided to the cover detection rod 120 included in the side cover detection member 114, and the coupling opening 124A is formed in the detection lever 124. Also, an arrangement may be made in which a coupling opening is formed in the cover detection rod 120, and a guide pin is provided to the detection lever 124.

DESCRIPTION OF THE REFERENCE NUMERALS

10 overlock sewing machine, 12 looper unit, 14 upper looper (looper), 14A upper looper inlet, 14B upper looper blade tip, 16 lower looper (looper), 16A lower looper inlet, 16B lower looper blade tip, 20 threading mechanism, 22 air flow path switching mechanism, 24 main body portion, 24A upper looper thread insertion opening, 24B lower looper thread insertion opening, 24C upper looper thread discharging tube, 24D lower looper thread discharging tube, 26 selection knob, 28 upper looper conducting tube, 30 lower looper conducting tube, 32 tube support member, 34 slide tube, 40 threading switching mechanism, 42 support base, 42A long opening, 42P pin, 44 slide plate, 44A slide opening, 44B slide opening, 44B1 large-diameter portion, 44P pin, 46 slide tube spring, 48 support shaft, 50 operating shaft, 52 switching transmission member, 52P pin, 52A engagement pin, switching member, 54A support arm, 54B opening portion, 54C switching arm, 54C1 contact tab, 54D engagement arm, 54E engagement arm, 54P coupling pin, 56 switching knob, 60 main shaft fixing mechanism, 62 fixing shaft, 62A groove portion, 64 main shaft fixing plate, 64A notch, 66 main shaft, 70 looper cover, 72 hinge coupling member, 72L hinge portion, 72R hinge portion, 72R1 stopper tab, 80 hinge mechanism, 82 hinge plate (support member), 82L support portion, 82R support portion, 82R1 cam tab, 82R2 cam portion, 84 hinge shaft, 86 hinge spring (shaft force-applying member), 90 side cover, 90A housing portion, 90B fixing portion, 90C stopper, 90D detection shaft pressing portion, 92 hinge member, 94 engagement member, 94A hook portion, 96 reception plate, 100 safety mechanism, 102 detection base (switch fixing member), 102A guide plate portion, 102B fixing plate portion, 102C first guide opening, 102D second guide opening, 102E switch fixing portion, 106 switch fixing base, 108 switch, 108A operating protrusion, 110 looper cover detection member, 110A base plate portion, 110B switching plate portion, 110C hinge shaft linkage portion (engagement portion), 110D pressing portion, 112 guide pin (second pin), 114 side cover detection member, 116 cover detection shaft, 118 detection spring (force-applying member), 120 cover detection rod, 120A coupling tab, 120B coupling opening, 122 guide pin (first pin), 124 detection lever (lever), 124A coupling opening, 124B cam opening (cam groove), 124B1 first cam opening portion, 124B2 inclined cam opening portion, 124B3 second cam opening portion, 124C switch pressing portion, 130 sewing machine main body, 130A through hole, 132 unit base, 132A insertion opening, 132P support shaft, 134 front cover, 136 needle plate, ER1 E-ring, ER2 E-ring, ER3 E-ring, ER4 E-ring, ER5 E-ring, ER6 E-ring, ER7 E-ring, TH1 upper looper thread, TH2 lower looper thread, W washer.

What is claimed is:

1. An overlock sewing machine comprising:

a switching member configured to switch, between a threading state and a sewing-enabled state, a threading mechanism provided to a sewing machine main body so as to support threading for a looper;

a looper cover coupled to a hinge shaft arranged on a front side of the threading mechanism with a left-right direction as an axial direction thereof, such that it can be operated to switch between an open state and a closed state;

a side cover coupled to the sewing machine main body such that it is positioned on one side with respect to the threading mechanism defined in the left-right direction and such that it can be operated to switch between an open state and a closed state;

a switch comprising an operating protrusion, and configured such that, when the operating protrusion is pressed, the switch detects the closed state of the looper cover, the closed state of the side cover, and the sewing-enabled state of the threading mechanism;

a looper cover detection member configured to operate such that it is moved from a non-switching position to a switching position according to a transition of the looper cover from the open state to the closed state, and such that, after the looper cover detection member reaches the switching position, the looper cover detection member operates the switching member so as to switch the threading mechanism to the sewing-enabled state;

a side cover detection member configured to operate such that it is moved from a non-detection position to a detection position according to a transition of the side cover from the open state to the closed state; and a lever coupled to the looper cover detection member and the side cover detection member, and configured to switch between a pressing state in which it presses the operating protrusion and a non-pressing state in which it does not press the operating protrusion, according to an operating state of the looper cover detection member and an operating state of the side cover detection member, wherein, when the looper cover detection member is moved to a switching position and the side cover detection member is moved to a detection position, the lever is set to the pressing state.

2. The overlock sewing machine according to claim 1, wherein the looper cover detection member is configured such that, when it is moved from the non-switching position toward one side in the left-right direction, it is set to the switching position, wherein the side cover detection member is configured such that, when it is moved from the non-detection position toward the other side in the left-right direction, it is set to the detection position, wherein the lever is rotatably coupled to the side cover detection member by a first pin, and wherein a cam groove is formed in the lever such that a second pin provided to the looper cover detection member is inserted into the cam groove so as to allow the second pin to be moved.

3. The overlock sewing machine according to claim 2, wherein the side cover detection member is supported by the sewing machine main body such that it can be relatively moved, and is forced toward the non-detection position side by a force-applying member, and wherein, when the side cover is switched from the open state to the closed state, the side cover detection member is pressed by the side cover so as to move the side cover detection member from the non-detection position to the detection position.

4. The overlock sewing machine according to claim 2, wherein the switch is fixed by a switch fixing member, and wherein the first pin and the second pin are slidably coupled to the switch fixing member.

5. The overlock sewing machine according to claim 2, wherein the looper cover and the hinge shaft are configured such that they can be moved as a single unit in an axial direction of the hinge shaft, wherein, when the looper cover is moved to a completely closed position toward one side in the axial direction of the hinge shaft from an interim closed state after it is turned from the open state to the closed state so as to be set to the interim closed state, the looper cover is switched to the closed state, and wherein an engagement portion is formed in the looper cover detection member so as to allow the hinge shaft to be engaged with the engagement portion such that they can be moved as a single unit in the axial direction of the hinge shaft.

6. The overlock sewing machine according to claim 5, wherein the hinge shaft is rotatably supported by a support member, and is forced by a shaft force-applying member toward one side in the axial direction, wherein a cam portion is formed in the support member such that, when the looper cover is set to the open state, it is engaged with the looper cover so as to restrict a movement of the looper cover toward one side in the axial direction of the hinge shaft, and wherein, upon turning the looper cover from the open position to the interim closed position, an engagement state between the cam portion and the looper cover is released so as to enable the movement of the looper cover toward the one side in the axial direction of the hinge shaft.

* * * * *